US011465431B2

(12) United States Patent
Brasch et al.

(10) Patent No.: US 11,465,431 B2
(45) Date of Patent: Oct. 11, 2022

(54) SELF-ADHESIVE, HEAT-SENSITIVE RECORDING MATERIAL

(71) Applicant: Papierfabrik August Koehler SE, Oberkirch (DE)

(72) Inventors: Uwe Brasch, Offenburg (DE); Lutz Kuhne, Ohlsbach (DE); Jurgen Keske, Neuried (DE); Matthias Schulte, Oberkirch (DE)

(73) Assignee: PAPIERFABRIK AUGUST KOEHLER SE, Oberkirsch (DE)

( * ) Notice: Subject to any disclaimer, the term of this patent is extended or adjusted under 35 U.S.C. 154(b) by 272 days.

(21) Appl. No.: 16/084,850

(22) PCT Filed: Mar. 14, 2017

(86) PCT No.: PCT/EP2017/055889
§ 371 (c)(1),
(2) Date: Sep. 13, 2018

(87) PCT Pub. No.: WO2017/157876
PCT Pub. Date: Sep. 21, 2017

(65) Prior Publication Data

US 2019/0077178 A1 Mar. 14, 2019

(30) Foreign Application Priority Data

Mar. 14, 2016 (EP) ..... 16160117

(51) Int. Cl.

| | |
|---|---|
| ***B41M 5/333*** | (2006.01) |
| ***B41M 5/337*** | (2006.01) |
| ***B41M 5/327*** | (2006.01) |
| ***B41M 5/44*** | (2006.01) |

(52) U.S. Cl.
CPC ..... *B41M 5/443* (2013.01); *B41M 5/3333* (2013.01); *B41M 5/3377* (2013.01); *B41M 5/3275* (2013.01); *B41M 2205/04* (2013.01); *B41M 2205/28* (2013.01); *B41M 2205/40* (2013.01)

(58) Field of Classification Search
CPC ..... B41M 5/3275; B41M 5/3333; B41M 5/3377; B41M 5/443; B41M 2205/04; B41M 2205/28; B41M 2205/40
See application file for complete search history.

(56) References Cited

U.S. PATENT DOCUMENTS

| | | | | |
|---|---|---|---|---|
| 4,851,383 | A | 7/1989 | Fickenscher et al. | |
| 5,424,182 | A * | 6/1995 | Marginean, Sr. | B41M 5/32 430/338 |
| 5,840,657 | A | 11/1998 | Mehta et al. | |
| 5,866,508 | A * | 2/1999 | Sawamura | B41M 5/3375 427/152 |
| 5,977,021 | A | 11/1999 | Aoyama et al. | |
| 9,834,022 | B2 * | 12/2017 | Morita | B41M 5/41 |
| 2006/0063013 | A1 * | 3/2006 | Ikeda | B41M 5/42 428/447 |
| 2014/0121099 | A1 * | 5/2014 | Taoka | C09D 143/04 503/201 |

FOREIGN PATENT DOCUMENTS

| | | | | |
|---|---|---|---|---|
| CN | 1751891 | A | 3/2006 | |
| CN | 103317849 | A | 9/2013 | |
| DE | 19757589 | B4 | 9/2007 | |
| EP | 0780241 | A1 | 6/1997 | |
| EP | 1637339 | A1 | 3/2006 | |
| EP | 2641740 | A1 | 9/2013 | |
| EP | 2957427 | A1 | 12/2015 | |
| JP | 2014040075 | A | 3/2014 | |
| WO | WO-2015111518 | A1 * | 7/2015 | B41M 5/30 |

OTHER PUBLICATIONS

International Search Report dated Sep. 23, 2016 (non-English).
Office Action for Brazilian Application No. BR112018068648-4, dated May 6, 2021, 4 pages.
Office Action for Chinese Application No. 2021041502515230, dated Apr. 20, 2021,4 pages.
Office Action for Chinese Application No. 201780017327.1, dated Nov. 13, 2020, 10 pages.
Office Action for Korean Application No. 10-2018-7029701, dated Nov. 28, 2020, 8 pages.
Office Action for Chinese Application No. 201780017327.1, dated Sep. 30, 2021, 10 pages.
Office Action for Chinese Application No. 201780017327.1, dated Feb. 21, 2022, 5 pages.

* cited by examiner

*Primary Examiner* — Gerard Higgins
(74) *Attorney, Agent, or Firm* — Fay Sharpe LLP

(57) ABSTRACT

The invention relates to a self-adhesive, heat-sensitive recording material, comprising a carrier substrate, a heat-sensitive, color-forming layer that is applied on one side of the carrier substrate and contains at least a non-phenolic color developer in and at least one color former, a siliconized layer on the upper side of the heat-sensitive, color-forming layer that is applied on the carrier substrate, as well as an adhesive layer on the side of the carrier substrate facing away from the heat-sensitive, color-forming layer.

21 Claims, No Drawings

SELF-ADHESIVE, HEAT-SENSITIVE RECORDING MATERIAL

The invention relates to a self-adhesive, heat-sensitive recording material, comprising a carrier substrate, a heat-sensitive colour-forming layer applied to one side of the carrier substrate, comprising at least one non-phenolic colour developer and at least one colour former, a siliconised layer on the upper side of the heat-sensitive colour-forming layer applied on the carrier substrate, and an adhesive layer on the side of the carrier substrate facing away from the heat-sensitive colour-forming layer, and a method for the production and use thereof. The invention also relates to a semi-finished product, to the production thereof and to the use thereof for producing the self-adhesive, heat-sensitive recording material.

Self-adhesive, heat-sensitive recording materials for thermal direct printing applications which comprise a heat-sensitive colour-forming layer (thermal reaction layer) applied to the carrier substrate and an adhesive layer on the other side of the carrier substrate are known. A colour former and a colour developer are usually present in the heat-sensitive colour-forming layer, which react with one another under the action of heat and thus lead to colour development.

These self-adhesive, heat-sensitive recording materials are usually applied to a carrier sheet (release liner or liner, for short) so that the individual units of the self-adhesive heat-sensitive recording material do not stick to one another.

So-called carrier-free (linerless) self-adhesive, heat-sensitive recording materials are also known. In this case, a siliconised layer is usually applied to the heat-sensitive colour-forming layer. These materials are characterised in that they are not applied to a carrier material, but can be rolled up on themselves so that the heat-sensitive colour-forming layer onto which a siliconised layer is applied is in direct contact with the adhesive layer. Since components of the adhesive layer, especially the plasticisers, can act on the heat-sensitive colour-forming layer, which leads to reduced writing performance, these carrier-free self-adhesive heat-sensitive recording materials additionally have a protective layer (top coat) which is located between the heat-sensitive colour-forming layer and the siliconised layer.

However, the use of a protective layer is associated with significantly increased production costs, so the cost advantages achieved by the use of a carrier-free material are consumed again. In addition, the open-pored surface of conventional thermal papers without a protective layer is not able to be well coated with silicone. Consequently, large amounts of silicone need to be applied, which not only drives up the production costs, but also accounts for deposits on the thermal print heads.

U.S. Pat. No. 4,851,383 A thus discloses a self-adhesive heat-sensitive recording material, comprising a carrier material having a heat-sensitive layer on the one side and an adhesive layer on the other side. A protective layer on the upper side of the heat-sensitive layer is provided with a siliconised layer.

DE 19757589 B4 discloses a carrier-free, heat-sensitive adhesive recording sheet, comprising a layer carrier, a heat-sensitive recording layer provided on one side of the layer carrier, a barrier layer provided on the heat-sensitive recording layer, a release layer provided on the barrier layer and an adhesive layer provided on the other side of the layer carrier, wherein the barrier layer is formed from a coating composition, comprising silicic acid, present in the form of a colloid containing water as dispersion medium, and at least one resin selected from water-soluble resins and water-dispersible resins.

U.S. Pat. No. 5,840,657 discloses a multi-layer, carrier-free recording material having a heat-sensitive layer containing a phenolic colour developer on the one side and an adhesive layer on the other side. In addition, two further layers—a base layer and a cover layer—made of a polymer are applied to the heat-sensitive layer. The carrier material is only partially coated in order to make selected parts of the surface printable.

The aim of the present invention is to eliminate the disadvantages of the prior art described above. Especially, the aim of the invention is to provide a self-adhesive heat-sensitive recording material which has the lowest possible production costs and a high resistance to plasticisers contained in the adhesive layer and, in addition to a desirably high dynamic pressure sensitivity, also has good storage stability, especially even under conditions of high storage temperature and ambient humidity, without the functional properties necessary for the application, such as surface whiteness and thermal responsiveness, being lost. In addition, the self-adhesive, heat-sensitive recording material should allow good siliconisation of the surface of the heat-sensitive colour-forming layer. Furthermore, it is preferable to provide a self-adhesive, heat-sensitive recording material which can also be used without a carrier. Finally, it is preferable to provide a recording material which is suitable in environmental terms.

According to the invention, this aim is addressed with a self-adhesive, heat-sensitive recording material according to claim 1, comprising a carrier substrate, a heat-sensitive colour-forming layer applied to one side of the carrier substrate, comprising at least one non-phenolic colour developer and at least one colour former, a siliconised layer on the upper side of the heat-sensitive colour-forming layer applied on the carrier substrate, and an adhesive layer on the side of the carrier substrate facing away from the heat-sensitive colour-forming layer, which is characterised in that the siliconised layer rests directly on the heat-sensitive colour-forming layer.

Owing to the direct application of the siliconised layer to the heat-sensitive colour-forming layer and the associated absence of a protective layer between the siliconised layer and the heat-sensitive colour-forming layer, the production of the self-adhesive heat-sensitive recording material according to the invention is associated with significantly lower complexity and significantly lower costs.

The heat-sensitive colour-forming layer preferably additionally contains at least one flaky pigment.

The at least one flaky pigment is preferably selected from the group consisting of kaolin, $Al(OH)_3$ and/or talcum. The use of kaolin is especially preferred. The use of a coating kaolin is very especially preferred. Such a kaolin is available, for example, under the trade name Kaolin ASP 109 (BASF, Germany).

The use of these flaky pigments, especially of kaolin, has the advantage especially that the heat-sensitive colour-forming layer can be siliconised very well.

The term flaky pigment is understood to mean a pigment in which the ratio of diameter to thickness is approximately 7 to 40:1, preferably about 15 to 30:1.

The particle size of the flaky pigment is preferably configured such that at least about 70%, preferably at least about 85%, of the particles have a particle size of about <2 μm (SediGraph). The pH of the flaky pigment in aqueous solution is preferably 6 to 8.

The at least one flaky pigment is preferably present in the heat-sensitive colour-forming layer of the self-adhesive, heat-sensitive recording material according to the invention in an amount of about 5 to about 60 wt. %, especially preferably in the amount of about 15 to about 55 wt. %, in relation to the total solid content of the heat-sensitive layer. If there is less than 5 wt. % flaky pigment, this has the disadvantage that good siliconisation is no longer guaranteed. The use of more than 60 wt. % has the disadvantage that the tendency to deposit on the print head increases and the writing performance decreases, since the ratios between pigments, binders, colour transmitters and developers are adversely affected.

The choice of the carrier substrate is not critical. However, it is preferable to use paper, synthetic paper and/or a plastic film as the carrier substrate.

The self-adhesive, heat-sensitive recording material according to the invention is preferably a carrier-free (linerless) self-adhesive, heat-sensitive recording material.

Here, carrier-free means that the self-adhesive, heat-sensitive recording material according to the invention is not applied to a carrier material but is wound up on itself. This has the advantage that the production costs can be further reduced, more running metres per roll can be achieved, no disposal cost for disposing the liner is necessary and more labels can be transported per specific cargo capacity.

The at least one non-phenolic colour developer is preferably a sulfonylurea and/or a compound of the formula (I),

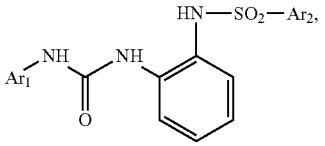

(I)

wherein $Ar_1$ and $Ar_2$ are a phenyl group and/or a $C_1$-$C_4$alkyl-substituted phenyl group.

A compound of the formula (I) is very especially preferred.

The $C_1$-$C_4$-alkyl-substituted phenyl group is preferably a methyl group, especially preferably a para-methyl residue.

In an especially preferred embodiment, $Ar_1$ and $Ar_2$ are a para-methyl-substituted phenyl group.

In another especially preferred embodiment, $Ar_1$ is a phenyl group and $Ar_2$ is a para-methyl-substituted phenyl group.

In a very especially preferred embodiment, $Ar_1$ and $Ar_2$ are each a phenyl group, i.e. the at least one colour developer is N-(2-(3-phenylureido)phenyl)benzenesulfonamide (hereinafter also referred to as NKK 1304; manufacturer: Nippon Soda Co. Ltd.).

The sulfonylurea contained, in addition to or instead of a colour developer according to formula (I), in the colour-forming heat-sensitive layer of the self-adhesive heat-sensitive recording material according to the invention is preferably chosen from the group consisting of N'-(p-toluenesulfonyl)-N'-phenylurea, N-(p-toluenesulfonyl)-N'-3-(p-toluenesulfonyl-oxy-phenyl)-urea, (trade name Pergafast 201®, PF201 from BASF) and/or 4,4'-bis-(p-tolylsulfonylureido)-diphenylmethane.

Very especially preferred is an embodiment of the self-adhesive heat-sensitive recording material which is characterised in that the heat-sensitive colour-forming layer contains N-(2-(3-phenylureido)phenyl)benzenesulfonamide (NKK 1304) and/or N-(p-toluenesulfonyl)-N'-3-(p-toluenesulfonyl-oxy-phenyl)-urea (Pergafast 201 (PF201), from BASF) as a colour developer.

The use of N-(2-(3-phenylureido)phenyl)benzenesulfonamide (NKK 1304) and/or N-(p-toluenesulfonyl)-N'-3-(p-toluenesulfonyl-oxy-phenyl)-urea (PF201) has especially the advantage that the writing performance is good even in the case of prolonged storage.

Most preferred is the use of N-(2-(3-phenylureido)phenyl)benzenesulfonamide (NKK 1304) since the use thereof leads to even better writing performance even in the case of prolonged storage.

The use of a non-phenolic colour developer is environmentally sound.

The sulfonylurea and/or the compound of formula (I) are preferably present in an amount of about 5 to about 40 wt. %, especially preferably in an amount of about 10 to about 25 wt. %, in relation to the total solid content of the heat-sensitive layer. If the amount of colour developer is less than 5 wt. %, this has the disadvantage that the writing performance is no longer guaranteed. If the amount of 40 wt. % of colour developer is exceeded, this has the disadvantage that the economic viability is compromised without the writing performance significantly increasing.

The present invention does not have any substantial restrictions as regards the choice of colour former. However, the colour former is preferably a dye of the triphenylmethane type, of the fluoran type, of the azaphthalide type and/or of the fluorene type. A very especially preferred colour former is a fluoran-type dye because it allows a recording material to be provided that has an appealing price-performance ratio on account of its availability and the balance of application-related properties.

Especially preferred dyes are of the fluoran type:

3-diethylamino-6-methyl-7-anilinofluoran,
3-(N-ethyl-N-p-toluylamino)-6-methyl-7-anilinofluoran,
3-(N-ethyl-N-isoamylamino)-6-methyl-7-anilinofluoran,
3-diethylamino-6-methyl-7-(o,p-dimethylanilino)fluoran,
3-pyrrolidino-6-methyl-7-anilinofluoran,
3-(cyclohexyl-N-methylamino)-6-methyl-7-anilinofluoran,
3-diethylamine-7-(m-trifluoromethylanilino)fluoran,
3-N-n-dibutylamino-6-methyl-7-anilinofluoran,
3-diethylamino-6-methyl-7-(m-methylanilino)fluoran,
3-N-n-dibutylamino-7-(o-chloroanilino)fluoran,
3-(N-ethyl-N-tetrahydrofurfurylamine)-6-methyl-7-anilinofluoran,
3-(N-methyl-N-propylamine)-6-methyl-7-anilinofluoran,
3-(N-ethyl-N-ethoxypropylamine)-6-methyl-7-anilinofluoran,
3-(N-ethyl-N-isobutylamine)-6-methyl-7-anilinofluoran and/or
3-dipentylamine-6-methyl-7-anilinofluoran.

The at least one colour former is preferably present in an amount of about 2 to about 20 wt. %, preferably of about 5 to about 15 wt %, in relation to the total solid content of the heat-sensitive layer.

If, in addition to the at least one colour former, there is another colour former, this is preferably present in an amount from 0.5 to 5 wt. %, in relation to the total solid content of the heat-sensitive layer.

If the amount of colour former is less than 2 wt. %, this has the disadvantage that the functionality is no longer guaranteed. If the amount of 20 wt. % of colour former is exceeded, this has the disadvantage that the economic viability is significantly compromised without the writing performance significantly increasing.

The self-adhesive heat-sensitive recording material according to the invention can contain conventional additives in the heat-sensitive colour-forming layer, such as sensitisers, stabilisers, binders, release agents and/or brighteners.

In general, substances are advantageously considered as sensitisers which have a melting point between about 90 and about 150° C. and which, in the melted state, dissolve the colour-forming components (colour formers and colour developers) without disrupting the formation of the colour complex.

The sensitiser is preferably a fatty acid amide, such as stearamide, behenic amide or palmitamide, an ethylene-bis-fatty acid amide, such as N,N'-ethylene-bis-stearic acid amide or N,N'-ethylene-bis-oleic acid amide, a wax such as polyethylene wax or montan wax, a carboxylic acid ester, such as dimethyl terephthalate, dibenzyl terephthalate, benzyl-p-benzyloxybenzoate, di-(p-methylbenzyl)oxalate, di-(p-chlorobenzyl)oxalate or di-(p-benzyl)oxalate, an aromatic ether, such as 1,2-dimethylphenoxy-ethane, 1,2-di-(3-methylphenoxy)ethane, 2-benzyloxynaphthalene or 1,4-diethoxynaphthalene, an aromatic sulfone, such as diphenyl sulfone, and/or an aromatic sulfonamide, such as benzenesulfonanilide or N-benzyl-p-toluenesulfonamide.

The use of fatty acid amides is especially preferred, since these are inexpensive to purchase.

The stabilisers are preferably sterically hindered phenols, especially preferably 1,1,3-tris-(2-methyl-4-hydroxy-5-cyclohexyl-phenyl)-butane, 1,1,3-tris-(2-methyl-4-hydroxy-5-tert-butylphenyl)-butane, 1,1-bis-(2-methyl-4-hydroxy-5-tert-butylphenyl)-butane.

Urea-urethane compounds of the general formula (II), the commercial product UU (urea urethanes), or ethers derived from 4,4'-dihydroxydiphenyl sulfone, such as 4-benzyloxy-4'-(2-methylglycidyloxy)-diphenylsulfone (trade name NTZ-95®, Nippon Soda Co. Ltd.), or oligomeric ethers of the general formula (III) (trade name D90®, Nippon Soda Co. Ltd.) can be used as stabilisers in the recording material according to the invention.

poly(meth)acrylic acid esters, acrylate-butadiene copolymers, polyvinyl acetates and/or acrylonitrile-butadiene copolymers.

In a further preferred embodiment, there is at least one release agent (anti-stick agent) or lubricant in the heat-sensitive colour-forming layer. These agents are preferably fatty acid metal salts, such as, for example, zinc stearate or calcium stearate, or else behenate salts, synthetic waxes, for example in the form of fatty acid amides, such as, for example, stearic acid amide and behenic acid amide, fatty acid alkanolamides, such as, for example, stearic acid methylol amide, paraffin waxes of different melting points, ester waxes of different molecular weights, ethylene waxes, propylene waxes of different hardnesses and/or natural waxes, such as, for example, carnauba wax or montan wax.

In order to control the surface whiteness of the heat-sensitive recording material according to the invention, optical brighteners can be incorporated into the heat-sensitive colour-forming layer. These are preferably stilbenes.

In order to improve certain coating properties, it is preferable especially cases to add further components, especially rheological agents, such as thickeners and/or surfactants, to the necessary components of the heat-sensitive recording material according to the invention.

The application weight per unit area of the (dry) heat-sensitive colour-forming layer of the self-adhesive, heat-sensitive recording material according to the invention is preferably approximately 1 to approximately 10 g/m$^2$, especially preferably about 2 to about 6 g/m$^2$. If the application weight per unit area is less than 1 g/m$^2$, this has the disadvantage that functionality is no longer guaranteed. If the application weight per unit area of 10 g/m$^2$ is exceeded, this has the disadvantage that it is uneconomical and has negative properties, such as depositing on the print head.

As mentioned above, a siliconised layer is located directly on the heat-sensitive colour-forming layer. This siliconised layer is preferably based on at least one siloxane. In this preferred embodiment, this is at least a polyorganosiloxane, especially an acrylic polyorganosiloxane.

(II)

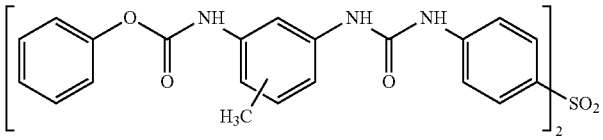

(III)

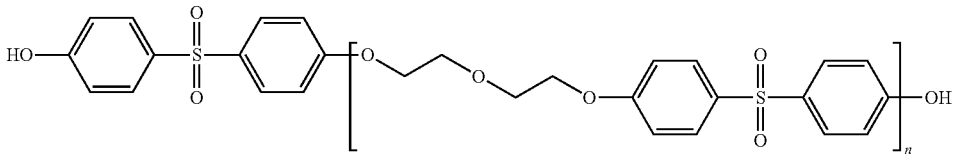

Urea urethane compounds of the general formula (II) are especially preferred.

In a further preferred embodiment, there is at least one binder in the heat-sensitive colour-forming layer. This preferably involves water-soluble starches, starch derivatives, methylcellulose, hydroxyethyl cellulose, carboxymethylcelluloses, partially or completely saponified polyvinyl alcohols, chemically modified polyvinyl alcohols or styrene-maleic anhydride copolymers, styrene-butadiene copolymers, acrylamide-(meth)-acrylate copolymers, acrylamide-acrylate-methacrylate terpolymers, polyacrylates, In a further embodiment, the siliconised layer of the self-adhesive heat-sensitive recording material according to the invention comprises a mixture of at least two siloxanes. A mixture of at least two acrylic polyorganosiloxanes is preferred.

Examples of very especially preferred siloxanes are siloxanes which are known under the trade names TEGO® RC 902 and TEGO® RC 711 (both from Evonik, Germany).

The application weight per unit area of the siliconised layer is about 0.3 to about 2.5 g/m$^2$, preferably about 0.5 to about 1.5 g/m$^2$, and very especially preferably about 0.6 to about 1.0 g/m$^2$. If the application weight per unit area is less than 0.3 g/m$^2$, this has the disadvantage that the release action is no longer guaranteed. If an application weight per unit area of 2.5 g/m$^2$ is exceeded, this has the disadvantage that the economic viability decreases and the risk of deposits on the thermal head of the printer increases.

The siliconised layer is preferably anhydrous. It is also preferable for the siliconised layer to contain no Pt catalysts.

The siliconised layer preferably contains an initiator, especially preferably a photoinitiator. The latter serves for the free-group curing of the silicone. Very especial preference is given to TEGO® Photoinitiator A18 (from Evonik, Germany). The siliconised layer can preferably contain further additives, such as matting agents and/or adhesion additives.

The adhesive layer which is applied to the side of the carrier material facing away from the heat-sensitive colour-forming layer comprises at least one adhesive, preferably a hot-melt adhesive.

The hot-melt adhesive is especially preferably a rubber- and/or acrylate-based hot-melt adhesive.

Examples of very especially preferred hot-melt adhesives are known under the trade names TLH4280E (Bostik), PS8746 (Henkel/Technomelt), PS1212 (Novamelt) and/or L1945 (Collano).

The application weight per unit area of the adhesive layer is preferably about 10 to about 40 g/m$^2$, especially preferably about 12 to about 25 g/m$^2$. If the application weight per unit area is less than 10 g/m$^2$, this has the disadvantage that adhesion is no longer guaranteed. If an application weight per unit area of 40 g/m$^2$ is exceeded, this has the disadvantage of decreasing economic viability and increasing the risk of adhesion of guide rollers and cutting blades in label dispensers.

In a very especially preferred embodiment, the self-adhesive, heat-sensitive recording material according to the invention is carrier-free, the at least one colour developer is a sulfonylurea and the flaky pigment is a coating kaolin. In this very especially preferred embodiment, the sulfonylurea is present in an amount of about 5 to about 40 wt. % in relation to the total solid content of the heat-sensitive layer. In this very especially preferred embodiment, the flaky pigment is present in an amount of about 5 to about 60 wt. % relative to the total solid content of the heat-sensitive layer.

In a likewise very especially preferred embodiment, the self-adhesive, heat-sensitive recording material according to the invention is carrier-free, the at least one colour developer contains N-(2-(3-phenylureido)-phenyl)benzenesulfonamide and the flaky pigment is a coating kaolin. The quantities of N-(2-(3-phenylureido)-phenyl)benzenesulfonamide and flaky kaolin used are also present in this embodiment at about 5 to about 40 wt. %. or about 5 to about 60 wt. %.

The self-adhesive, heat-sensitive recording material according to the invention can be obtained using known production methods.

The production method according to the invention is characterised, however, in that an aqueous suspension containing the starting materials of the heat-sensitive colour-forming layer is applied to a carrier substrate and dried, the heat-sensitive colour-forming layer is subsequently siliconised and an adhesive layer is applied on the side of the carrier substrate facing away from the heat-sensitive colour-forming layer.

Very especially preferably, the self-adhesive heat-sensitive recording material according to the invention is obtained using a method in which an aqueous suspension containing the starting materials of the heat-sensitive colour-forming layer is applied to a carrier substrate and dried, wherein the aqueous coating suspension has a solid content of about 20 to about 75 wt. %, preferably of about 25 to about 50 wt. %, and using the curtain coating method at an operating speed of the coater of at least about 400 m/min, and is dried, the heat-sensitive colour-forming layer is subsequently siliconised and an adhesive layer is applied on the side of the carrier substrate facing away from the heat-sensitive colour-forming layer.

This method is advantageous especially from an economic perspective.

If the value of the solids content is less than 20 wt. %, then the economic viability is impaired, since a large amount of water has to be removed from the coating in a short time by careful drying, which has an adverse effect on the coating speed. If, on the other hand, the value of 75 wt. % is exceeded, this simply leads to increased technical complexity to ensure the stability of the coating paint curtain during the coating process.

As mentioned above, it is advantageous to produce the self-adhesive, heat-sensitive recording material according to the invention by means of a method in which the aqueous coating suspension is applied using the curtain coating method at an operating speed of the coater of at least about 400 m/min. The so-called curtain coating method is known to a person skilled in the art and is characterised by the following criteria:

In the curtain coating method, a freely falling curtain of a coating dispersion is formed. By means of free fall, the coating dispersion in the form of a thin film (curtain) is 'cast' onto a substrate in order to apply the coating dispersion to the substrate. DE 10196052 T1 discloses the use of the curtain coating method in the production of information-recording materials, including among other things heat-sensitive recording materials, wherein multi-layer recording layers are applied to substrates by applying the curtain consisting of a plurality of coating dispersion films.

Setting the operating speed of the coater to at least approximately 400 m/min has both economic and technical advantages. Especially preferably, the operating speed is at least approximately 750 m/min, very especially preferably at least about 1000 m/min and most especially preferably at least about 1500 m/min. It is especially surprising that even at the latter speed the heat-sensitive recording material produced is not adversely affected in any way and that the procedure itself runs optimally at this high speed.

In a preferred embodiment of the method according to the invention, the aqueous deaerated application suspension has a viscosity of about 100 to about 1000 mPas (Brookfield, 100 rpm, 20° C.). If the value of about 100 mPas is not reached or the value of about 1000 mPas is exceeded, this then causes the coating material to run inadequately on the coating assembly. Especially preferably, the viscosity of the aqueous deaerated application suspension is about 150 to about 700 mPas.

In a preferred embodiment, in order to optimise the method, the surface tension of the aqueous application suspension can be adjusted to from about 30 to about 60 mN/m, preferably from about 35 to about 50 mN/m (measured according to the Du Noüy ring method, DIN 53914).

The heat-sensitive colour-forming layer can be formed on-line or off-line in a separate coating process. This also applies to layers or intermediate layers which may be subsequently applied.

It is advantageous if the dried heat-sensitive colour-forming layer undergoes a smoothing step. Here, it is advantageous to set the Bekk smoothness, measured according to DIN 53101, at from about 150 to about 1500 sec, preferably at from about 250 to about 800 sec.

The preferred embodiments listed in the context of the self-adhesive, heat-sensitive recording material according to the invention likewise apply to the method according to the invention.

The present invention also relates to a self-adhesive, heat-sensitive recording material which can be obtained using the method according to the invention described above.

The present invention also relates to a method for producing a semi-finished product, which is characterised in that an aqueous suspension containing the starting materials of the heat-sensitive colour-forming layer is applied to a carrier substrate and dried. The semi-finished product according to the invention is thus produced similarly to the self-adhesive, heat-sensitive recording material according to the invention, but without the subsequent siliconisation and application of the adhesive layer.

The preferred embodiments mentioned in the context of the self-adhesive, heat-sensitive recording material according to the invention and of the method for producing same apply accordingly to the method for producing the semi-finished product and to the semi-finished product which is likewise encompassed by the present invention.

The present invention further relates to the use of a semi-finished product comprising a carrier substrate, a heat-sensitive colour-forming layer applied to one side of the carrier substrate, said layer comprising at least one colour developer and at least one colour former, for producing a self-adhesive heat-sensitive recording material, as described above.

The advantages associated with the present invention can be summarised essentially as follows:

The present invention provides a self-adhesive, heat-sensitive recording material, which is preferably carrier-free and, in addition to a desirable high dynamic pressure sensitivity, also has extraordinarily good storage stability, especially even under conditions of high storage temperature and ambient humidity, without the functional properties necessary for the application, such as surface whiteness and thermal responsiveness, being lost. In addition, the composition of the heat-sensitive colour-forming layer enables good siliconisation of same. The self-adhesive, heat-sensitive recording material according to the invention is preferably carrier-free and can thus be wound up on itself. The colour-forming layer has a high resistance to components of the adhesive layer, especially to hydrophobic substances, such as plasticisers, fatty or oily substances, etc. This makes it possible to provide a carrier-free self-adhesive, heat-sensitive recording material. Furthermore, the self-adhesive, heat-sensitive recording material according to the invention is environmentally sound.

The self-adhesive, heat-sensitive recording material according to the invention is well suited for POS (point of sale) and/or label applications. It is also suitable for producing stickers, labels and travel luggage tags.

The invention is explained in detail below on the basis of non-limiting examples.

EXAMPLES

An aqueous application suspension for forming the heat-sensitive colour-forming layer of a heat-sensitive recording paper was applied under laboratory conditions by means of a bar coater on one side of a thermal base paper of 69 g/m$^2$. After drying, a thermal recording sheet was obtained. The amount of heat-sensitive colour-forming layer applied was between 4.0 and 4.5 g/m$^2$ On a production scale, the aqueous application suspension was applied to a paper sheet of a weight per unit area of 64 g/m$^2$ by means of the curtain coating method. The viscosity of the aqueous application suspension was 170-570 mPas (according to Brookfield, 100 rpm, 20° C.) (in the deaerated state). The coating unit was arranged in-line. The curtain coating method was operated at a speed of 450 m/min.

After application of the aqueous application suspension, the drying process of the coated paper carrier took place in a conventional manner. The application weight per unit area of the dry heat-sensitive layer was 4.0-4.5 g/m$^2$.

The formulas specified below were produced in that initially the dispersions A1, A2, B and C were mixed separately by grinding the components in a bead mill and said dispersions together with the other components were then mixed well with one another.

The heat-sensitive coating suspensions thus obtained (Formulas 1a, 1b, 2a, 2b, and 3), stemming from the Tables 1 to 6 below, were used to produce semi-finished products from a paper carrier and a heat-sensitive colour-forming layer.

TABLE 1

| Formula 1a | Component | Parts by weight | Note/trade name | Chemical nomenclature |
|---|---|---|---|---|
| Dispersion A1 | Colour former 1 | 11.06 | S-205 | 3-(N-ethyl-N-isopentylamino)-6-methyl-7-anilinofluoran |
| | PVA low viscosity, low-saponified (15%) | 20.04 | Poval 4-85, from Kuraray | Polyvinyl alcohol solution |
| Dispersion A2 | Colour former 2 | 16.58 | ODB-2 | 3-N-n-dibutylamino-6-methyl-7-anilinofluoran |
| | PVA low viscosity, low-saponified (15%) | 30.05 | Poval 4-85, from Kuraray | Polyvinyl alcohol solution |
| Dispersion B | Colour developer | 76.79 | Bisphenol A | 4,4'-isopropylenediphenol |
| | PVA low viscosity, low-saponified (15%) | 54.41 | Poval 4-85, from Kuraray | Polyvinyl alcohol solution |
| Dispersion C | Sensitiser | 25.62 | BON | 2-benzyloxynaphthalene |
| | PVA low viscosity, low-saponified (15%) | 18.15 | Poval 4-85, from Kuraray | Polyvinyl alcohol solution |
| | Stearic acid amide dispersion (25%) | 108.17 | | |

TABLE 1-continued

| Formula 1a | Component | Parts by weight | Note/trade name | Chemical nomenclature |
|---|---|---|---|---|
| | Zinc stearate dispersion (30%) | 54.9 | | |
| | PCC slurry (56%) | 121.77 | Precipitated calcium carbonate | |
| | Optical brightener (31.3%) | 5.75 | Blankophor PT | Anionic stilbene derivative |
| | PVA high viscosity, high-saponified (10%) | 330 | Poval 28-99 | Polyvinyl alcohol solution |
| | Crosslinking agent, glyoxal-based (42%) | 11.29 | Cartabond type, from Archroma | |
| | Rheological agent | 0.83 | Sterocoll type, BASF | Polyacrylamide, anionically modified |

TABLE 2

| Formula 1b | Component | Parts by weight | Note/trade name | Chemical nomenclature |
|---|---|---|---|---|
| Dispersion A1 | Colour former 1 | 11.06 | S-205 | 3-(N-ethyl-N-isopentylamino)-6-methyl-7-anilinofluoran |
| | PVA low viscosity, low-saponified (15%) | 20.04 | Poval 4-85, from Kuraray | Polyvinyl alcohol solution |
| Dispersion A2 | Colour former 2 | 16.58 | ODB-2 | 3-N-n-dibutylamino-6-methyl-7-anilinofluoran |
| | PVA low viscosity, low-saponified (15%) | 30.05 | Poval 4-85, from Kuraray | Polyvinyl alcohol solution |
| Dispersion B | Colour developer | 76.79 | Bisphenol A | 4,4'-isopropylenediphenol |
| | PVA low viscosity, low-saponified (15%) | 54.41 | Poval 4-85, from Kuraray | Polyvinyl alcohol solution |
| Dispersion C | Sensitiser | 25.62 | BON | 2-benzyloxynaphthalene |
| | PVA low viscosity, low-saponified (15%) | 18.15 | Poval 4-85, from Kuraray | Polyvinyl alcohol solution |
| | Stearic acid amide dispersion (25%) | 108.17 | | |
| | Zinc stearate dispersion (30%) | 54.9 | | |
| | Kaolin slurry (72%) | 94.71 | ASP 109 | |
| | Optical brightener (31.3%) | 5.75 | Blankophor PT | Anionic stilbene derivative |
| | PVA high viscosity, high-saponified (10%) | 330 | Poval 28-99 | Polyvinyl alcohol solution |
| | Crosslinking agent, glyoxal-based (42%) | 11.29 | Cartabond type, from Archroma | |
| | Rheological agent | 0.83 | Sterocoll type, BASF | Polyacrylamide, anionically modified |

TABLE 3

| Formula 2a | Component | Parts by weight | Note/trade name | Chemical nomenclature |
|---|---|---|---|---|
| Dispersion A1 | Colour former 1 | 9.0 | S-205 | 3-(N-ethyl-N-isopentylamino)-6-methyl-7-anilinofluoran |
| | PVA low viscosity, low-saponified (15%) | 16.31 | Poval 4-85, from Kuraray | Polyvinyl alcohol solution |
| Dispersion A2 | Colour former 2 | 21.0 | ODB-2 | 3-N-n-dibutylamino-6-methyl-7-anilinofluoran |
| | PVA low viscosity, low-saponified (15%) | 38.05 | Poval 4-85, from Kuraray | Polyvinyl alcohol solution |

TABLE 3-continued

| Formula 2a | Component | Parts by weight | Note/trade name | Chemical nomenclature |
|---|---|---|---|---|
| Dispersion B | Colour developer | 60 | NKK 1304 | N-[2-(3-Phenylureido)phenyl]benzenesulfonamide |
| | PVA low viscosity, low-saponified (15%) | 70.59 | Poval 4-85, from Kuraray | Polyvinyl alcohol solution |
| Dispersion C | Sensitiser | 36 | BON | 2-benzyloxynaphthalene |
| | PVA low viscosity, low-saponified (15%) | 25.51 | Poval 4-85, from Kuraray | Polyvinyl alcohol solution |
| | Stearic acid amide dispersion (25%) | 176.77 | | |
| | Zinc stearate dispersion (30%) | 0 | | |
| | Kaolin slurry (72%) | 94.88 | ASP 109, BASF | |
| | Optical brightener (31.3%) | 2.88 | Blankophor PT | Anionic stilbene derivative |
| | PVA high viscosity, high-saponified (10%) | 330 | Poval 28-99, from Kuraray | Polyvinyl alcohol solution |
| | Crosslinking agent, glyoxal-based (42%) | 11.29 | Cartabond type, from Archroma | |
| | Rheological agent | 0.83 | Sterocoll type, BASF | Polyacrylamide, anionically modified |

TABLE 4

| Formula 2b | Component | Parts by weight | Note/trade name | Chemical nomenclature |
|---|---|---|---|---|
| Dispersion A1 | Colour former 1 | 0 | S-205 | 3-(N-ethyl-N-isopentylamino)-6-methyl-7-anilinofluoran |
| | PVA low viscosity, low-saponified (15%) | 0 | Poval 4-85, from Kuraray | Polyvinyl alcohol solution |
| Dispersion A2 | Colour former 2 | 30.0 | ODB-2 | 3-N-n-dibutylamino-6-methyl-7-anilinofluoran |
| | PVA low viscosity, low-saponified (15%) | 54.36 | Poval 4-85, from Kuraray | Polyvinyl alcohol solution |
| Dispersion B | Colour developer | 60 | PF201 | N-(p-toluenesulfonyl)-N'-(3-(p-toluenesulfonyloxy)phenyl)-urea |
| | PVA low viscosity, low-saponified (15%) | 70.59 | Poval 4-85, from Kuraray | Polyvinyl alcohol solution |
| Dispersion C | Sensitiser | 36 | BON | 2-benzyloxynaphthalene |
| | PVA low viscosity, low-saponified (15%) | 25.51 | Poval 4-85, from Kuraray | Polyvinyl alcohol solution |
| | Stearic acid amide dispersion (25%) | 176.77 | | |
| | Zinc stearate dispersion (30%) | 0 | | |
| | Kaolin slurry (72%) | 94.88 | ASP 109, BASF | |
| | Optical brightener (31.3%) | 2.88 | Blankophor PT | Anionic stilbene derivative |
| | PVA high viscosity, high-saponified (10%) | 330 | Poval 28-99, from Kuraray | Polyvinyl alcohol solution |
| | Crosslinking agent, glyoxal-based (42%) | 11.29 | Cartabond type, from Archroma | |
| | Rheological agent | 0.83 | Sterocoll type, BASF | Polyacrylamide, anionically modified |

TABLE 5

| Formula 3 | Component | Parts by weight | Note/trade name | Chemical nomenclature |
|---|---|---|---|---|
| Dispersion A1 | Colour former 1 | 0 | S-205 | 3-(N-ethyl-N-isopentylamino)-6-methyl-7-anilinofluoran |
| | PVA low viscosity, low-saponified (15%) | 0 | Poval 4-85, from Kuraray | Polyvinyl alcohol solution |
| Dispersion A2 | Colour former 2 | 29 | ODB-2 | 3-N-n-dibutylamino-6-methyl-7-anilinofluoran |
| | PVA low viscosity, low-saponified (15%) | 52.54 | Poval 4-85, from Kuraray | Polyvinyl alcohol solution |
| Dispersion B | Colour developer | 46.4 | PF201 | N-(p-toluenesulfonyl)-N'-(3-(p-toluenesulfonyloxy)phenyl)-urea |
| | PVA low viscosity, low-saponified (15%) | 30.94 | Poval 4-85, from Kuraray | Polyvinyl alcohol solution |
| Dispersion C | Sensitiser | 15.47 | BON | 2-benzyloxynaphthalene |
| | PVA low viscosity, low-saponified (15%) | 10.96 | Poval 4-85, from Kuraray | Polyvinyl alcohol solution |
| | Stearic acid amide dispersion (25%) | 213.6 | | |
| | Zinc stearate dispersion (30%) | 41.26 | | |
| | Kaolin slurry (72%) | 117.85 | ASP 109, BASF | |
| | Optical brightener (31.3%) | 1.85 | Blankophor PT | Anionic stilbene derivative |
| | PVA high viscosity, high-saponified (10%) | 290 | Poval 28-99 | Polyvinyl alcohol solution |
| | Crosslinking agent, glyoxal-based (42%) | 9.94 | Cartabond type, from Archroma | |
| | Rheological agent | 1.61 | Sterocoll type, BASF | Polyacrylamide, anionically modified |

A mixture of 50 parts of TEGO RC 902, 25 parts of TEGO RC 711 and 25 parts of TEGO RC 1772 (as matting agent), plus 3 to 5 parts of SR 9051 as an adhesion additive and 1.5 parts of photoinitiator A18 (manufacturer: Evonik, Germany; exception: SR9051 from Sartomer, Archema Group) was produced for the siliconisation. The siliconisation of the heat-sensitive colour-forming layer was carried out by means of a five-fold roller application with prior corona treatment.

The self-adhesive heat-sensitive recording materials based on the application suspensions listed in tables 1 to 5 were carrier-free and evaluated as described below. The results can be found in tables 6 and 7.

Storage Stability of the Carrier-Free, Self-Adhesive, Heat-Sensitive Recording Material:

In order to evaluate the storage stability of a carrier-free, self-adhesive, heat-sensitive recording material, the heat-sensitive recording material siliconised on the upper side (i.e. directly on the thermal reaction layer) was provided on both sides with hot-melt adhesives in order to simulate roll winding (i.e. the adhesive effect of the upper side and lower side).

The adhesives used were Technomelt PS 8746 (Henkel) and Collano L1 945 (Collano). These were already coated onto a carrier film.

For carrying out the procedure, an adhesive film was first laminated on the rear side of the thermal paper at room temperature and then a checkerboard pattern was thermally printed with 10 energy gradations on an Atlantek 200 thermal printer. The image density (optical density, OD) was measured from the printed image by means of a SpectroEye densitometer (from X-Rite).

A further strip of the same thermal paper, which is laminated on the rear side in the same manner but was not thermally printed in this case, was likewise laminated on the upper side with the adhesive film and subsequently stored in a climate-controlled cabinet at 60° C./50% relative humidity between Plexiglas plates and with a weight load of 10.5 kg. After defined time intervals of 1, 2 and 4 weeks, a sample was taken in each case and equilibrated at room temperature for 1 hour. The adhesive film was then removed from the upper side and the thermal side was dynamically printed on the Atlantek 200 thermal printer in order to determine the remaining writing performance. The following applies:

$$\%\ \text{change in writing performance} = \left(\frac{\text{Image density after storage}}{\text{Image density before storage}} - 1\right) * 100$$

(Image density determined at an energy density of 0.45 mJ/dot)

Determination of the Release Values

The applied method makes it possible to determine the force required to remove the release paper from the adhesive-coated upper material. This allows a pre-evaluation of the processing behaviour: very low values result in premature detachment of labels during the production or dispensing process; high values lead to tearing during the punch grid removal or to dispensing problems in the case of automatic dispensing.

The release force during a slow peel is the force required to peel a self-adhesively coated material from its release paper (or vice versa, the release paper from the self-adhesive material) at an angle of 180° and a clamping speed of 300 mm/min.

Apparatus Required:

The test apparatus used was a device that can separate a composite at a peel angle of 180° and a clamp speed of 300 mm/min with ±2% accuracy. The test apparatus had a back plate on which test strips were applied in such a way that an angle of 180° was maintained during the test. Metal bearing weights produced a pressure of 6.86 kPa (70 g/cm$^2$) on the material samples. The test strips were cut from a representative sample of the material. The strips were 50 mm wide and at least 175 mm long in the running direction. The cut was clean and straight. At least three strips were provided for each material sample.

Conditions:

The test strips were held at 23±2° C. for 20 hours between two flat metal plates under a pressure of 6.86 kPa (70 g/cm$^2$). This results in good contact between the release material and the adhesive. After this pressure storage, the strips between the plates were removed and equilibrated for at least four hours under standard conditions (23±2° C. and 50±5% rh) before the measurement.

Testing Process:

Each test strip was fastened over its full surface to the test plate using double-sided adhesive tape, followed by a peel test at 180°. In the process, the label was detached from the release material. The clamp speed was set to 300 mm/min. During the test, the force was read five times at intervals of 10 mm in the middle region of the strip. The average value for each strip is obtained from these five measurements.

Results:

The release force during a slow peel is given as the mean value in centinewtons per 50 mm (cN/50 mm).

The release values were determined using two different adhesives (tesa 7475 and 7476).

Determining Silicone Application

This test method enables rapid and precise determination of the amount of silicone of a release coating with minimal sample preparation. The release coating is located on a carrier material, as is used for producing release material for self-adhesive labels or other release applications.

Definition:

The silicone application weight is defined as the amount of cured silicone release coating per standard area of a carrier material. It is given in grams per square metre (9/).

Devices:

The method is based on x-ray fluorescence (XRF) analysis.

Material Samples:

A suitable number of test pieces were taken from a representative sample of the cover material of a laminate or siliconised release material to be examined. Contamination of the samples, especially with silicone-containing material, was avoided. The samples were cut out or stamped out onto a dry clean sheet of tissue paper and then grasped at the edge only by means of tweezers. The samples did not have to be pre-conditioned.

Testing Process:

The samples were then introduced into the device and moved into a special measuring chamber, where the irradiation with the primary x-ray radiation causes the emission of the secondary x-ray fluorescence which is characteristic of the examined element, in this case silicon. After a time of 30 to 60 seconds, the measurement was complete and the program gave the silicone application weight directly in g/m$^2$ of silicone (see also test results below). The XRF technique is a relative method, and not an absolute method. Therefore, a calibration curve had to be produced before routine analyses could be carried out. The calibration requires the device to be configured to register silicon x-ray radiation and then known standards to be measured. However, it should be emphasised that each carrier material provides a different background radiation. It is therefore not only necessary to produce the calibration curve for measuring a series of different silicone application weights, but also to carry this out separately for each carrier material.

Results:

The results are specified directly in grams of silicone per square metre. It should be noted here that elemental silicon has already been computationally converted to silicone.

A plurality of samples were taken from a representative coated substrate in order to detect possible fluctuations over the sheet width. In general, the longer the measurement time, the higher the measurement accuracy. Accuracies are on the order of ±0.05 to ±0.01 (g/m$^2$).

Methylene Blue Test

Application Area:

This test method describes a method for evaluating the coverage quality of silicone coatings. This test can only be carried out with paper substrates which can be stained with the colour test solution used.

Definition:

The coating quality is evaluated by testing with methylene blue stain. A certain amount of the coloured liquid is applied to the silicone-coated liner for a limited time; then the dye is rinsed off or wiped off, and the liner is dried. The coating quality is evaluated visually.

Procedure:

a. A 1-litre polyethylene bottle was placed on an electronic balance.

b. 5 grams of methylene blue were weighed into the vessel.

c. 1 litre of distilled water was added using a graduated cylinder. The vessel was closed and shaken intensively in order to dissolve the dye.

Test Equipment:

1. Cobb tester with ring having a diameter of approximately 11.5 cm.
2. Stopwatch with countdown and alarm function.
3. Small container with 200-ml marking.
4. Methylene blue solution.
5. Absorbent cleaning paper.

Material Samples:

Several samples of the release material were evaluated. If these samples originated from a specific point of the paper sheet, this was recorded accordingly for reference purposes.

Staining Test:

1. Cutting out a 14 cm×14 cm sample of the release paper. No holes or perforations are allowed in the protective paper.
2. The silicone surface was not touched before the test, since otherwise the staining can be distorted. The release paper sample is placed with the silicone side up under the test ring of the Cobb tester.
3. The ring is clamped on so that the dye does not escape during the test.
4. 200 ml of the colour solution is filled into the Cobb tester, and the stopwatch is started. The exposure time was 120 seconds.
5. The stain solution is drained after the exposure time chosen for the test, the test ring is released, and the test ring is lifted from the sample.
6. The test pattern is dabbed with absorbent paper, and the sample is dried for a further five minutes. When the sample is dry, it can be examined or measured.

Results:

The subjective assessment of the sample takes into account the general staining of the liner and the penetration of the colour solution into the base paper. No penetration should be visible in the case of good coating quality. The more visible and intensive the staining is, the greater the risk is that the adhesive will migrate through the silicone coating to the base paper and can thus cause release value problems (possibly dispensing problems in the case of labels or release value problems in the case of adhesive tapes, etc.).

The staining was evaluated using a scale of + to ++++, wherein ++++ represents complete staining of the base paper, such as with raw paper, and + represents a perfect colour test without visible penetration.

The methods described above can also be found in the 'FINAT Technical Handbook: Test Methods' 9th edition, August 2014, (FINAT, Worldwide Association for Self-Adhesive Labels and Related Products, The Hague, Netherlands).

Test Results:

The formulations 7 and 8 correspond to a self-adhesive heat-sensitive recording material on a carrier material (top coat) according to the prior art (manufacturer: Ricoh; paper type 150 UTB). The formulas 9 to 12 are embodiments according to the invention.

TABLE 7

Results of methylene blue test

| No. | Formula | Methylene blue colouration |
|---|---|---|
| 1 | Form. 1a (BPA and PCC) | ++++ |
| 2 | Form. 1a (BPA and PCC) | +++ |
| 3 | Form. 1a (BPA and PCC) | ++++ |
| 4 | Form. 1b (BPA and kaolin) | ++ |
| 5 | Form. 1b (BPA and kaolin) | + |
| 6 | Form. 1b (BPA and kaolin) | + |

TABLE 6

Results for determining release value and storage stability

| No. | Formula | Silicone application ($g/m^2$) | Release values (tesa 7475) Acrylate tape cN/in | Release values (tesa 7476) rubber tape cN/in | Writing performance % 60° C./50% rh Technomelt PS 8746 1 wk. | 2 wk. | 4 wk. | Collano L1 945 1 wk. | 2 wk. | 4 wk. |
|---|---|---|---|---|---|---|---|---|---|---|
| 1. | Form. 1a (BPA and PCC) | 0.84 | blocked | — | — | — | blocked | — | — | — |
| 2. | Form. 1a (BPA and PCC) | 1.34 | 509 | 355 | — | — | — | — | — | — |
| 3. | Form. 1a (BPA and PCC) | 1.05 | 966 | 464 | — | — | — | — | — | — |
| 4. | Form. 1b (BPA and kaolin) | 0.75 | 35 | — | — | — | 37.4 | — | — | — |
| 5. | Form. 1b (BPA and kaolin) | 1.45 | 5 | 46 | — | — | — | — | — | — |
| 6. | Form. 1b (BPA and kaolin) | 1.10 | 6 | 51 | — | — | — | — | — | — |
| 7. | Ricoh top coat 150 UTB | 0.78 | 9 | — | — | — | 98.7 | — | — | — |
| 8. | Ricoh top coat 150 UTB | 0.54 | 11 | — | 100.0 | 101.7 | 99.4 | 97.3 | 99.5 | 36.6 |
| 9. | Form. 2a (NKK 1304 and kaolin) | 0.69 | 16 | 169 | 86.3 | 80.1 | 75.3 | 73.2 | 75.4 | 10.6 |
| 10. | Form. 2a (NKK 1304 and kaolin) | 0.82 | 9 | — | — | — | 76.3 | — | — | — |
| 11. | Form. 2b (PF201 and kaolin) | 0.68 | 12 | 156 | 69.2 | 54.8 | 26.0 | 54.9 | 26.1 | 9.2 |
| 12. | Form. 3 (PF201 and kaolin) | 0.76 | 203 | — | — | — | 19.1 | — | — | — |

BPA: Bisphenol A

PCC: precipitated $CaCO_3$

NKK 1304: N-[2-(3-phenylureido)phenyl]benzenesulfonamide

PF201: N-(p-toluenesulfonyl)-N'-(3-(p-toluenesulfonyl-oxy-phenyl)-urea

TABLE 7-continued

| Results of methylene blue test | | |
|---|---|---|
| No. | Formula | Methylene blue colouration |
| 7 | Ricoh top coat 150 UTB | + |
| 8 | Ricoh top coat 150 UTB | + |
| 9 | Form. 2a (NKK 1304 and kaolin) | + |
| 10 | Form. 2a (NKK 1304 and kaolin) | + |
| 11 | Form. 2b (PF201 and kaolin) | + |
| 12 | Form. 3 (PF201 and kaolin) | + |

(++++) = clear blue colouration,
(+++) = blue colouration,
(++) = slight blue colouration,
(+) = barely visible blue colouration
BPA: Bisphenol A
PCC: Precipitated $CaCO_3$
NKK 1304: N-[2-(3-phenylureido)phenyl]benzenesulfonamide
PF201: N-(p-toluenesulfonyl)-N'-(3-(p-toluenesulfonyl-oxy-phenyl)-urea Tables 6 and 7 show that the heat-sensitive recording material according to the invention has very good release values for an average silicone application, has very good writing performance even after a storage time of 4 weeks at 60° C. and 50% relative humidity and can be very well siliconised, which is evident from the very little blue colouration after the methylene blue test.

The invention claimed is:

1. A self-adhesive, heat-sensitive recording material, comprising a carrier substrate, a heat-sensitive colour-forming layer applied to one side of the carrier substrate, said layer comprising at least one non-phenolic colour developer and at least one colour former, a siliconised layer on an upper side of the heat-sensitive colour-forming layer applied on the carrier substrate, and an adhesive layer on a side of the carrier substrate facing away from the heat-sensitive colour-forming layer, characterised in that the siliconised layer rests directly on the heat-sensitive colour-forming layer, that the siliconized layer is majoritively at least one siloxane and that the heat-sensitive colour-forming layer comprises at least one flaky pigment, and wherein the self-adhesive, heat-sensitive recording material is carrier-free and can be rolled up on itself so that the heat-sensitive colour-forming layer onto which the siliconized layer is applied is in direct contact with the adhesive layer.

2. A self-adhesive heat-sensitive recording material according to claim 1, characterised in that the carrier substrate is paper, synthetic paper and/or a plastic film.

3. A self-adhesive heat-sensitive recording material according to claim 1, characterised in that the self-adhesive heat-sensitive recording material is a carrier-free self-adhesive heat-sensitive recording material.

4. A self-adhesive heat-sensitive recording material according to claim 1, characterised in that the at least one colour developer is sulfonylurea and/or a compound of formula (I),

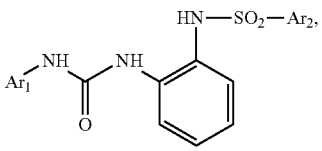

(I)

wherein $Ar_1$ and $Ar_2$ are a phenyl group and/or a $C_1$-$C_4$-alkyl-substituted phenyl group.

5. A self-adhesive, heat-sensitive recording material according to claim 4, characterised in that the sulfonylurea is N'-(p-toluenesulfonyl)-N'-phenylurea, N-(p-toluenesulfonyl)-N'-3-(p-toluenesulfonyl-oxy-phenyl)-urea and/or 4,4'-bis-(p-tolylsulfonylureido)-diphenylmethane.

6. A self-adhesive, heat-sensitive recording material according to claim 4, characterised in that the siliconised layer additionally contains an initiator.

7. A self-adhesive, heat-sensitive recording material according to claim 4, characterised in that the siliconised layer additionally contains a photoinitiator.

8. A self-adhesive, heat-sensitive recording material according to claim 1, characterised in that the at least one colour former is a triphenylmethane-type, fluoran-type, azaphthalide-type and/or fluorene-type dye.

9. A self-adhesive, heat-sensitive recording material according to claim 1, characterised in that the adhesive layer comprises at least one hot-melt adhesive.

10. A self-adhesive, heat-sensitive recording material according to claim 2, characterised in that the at least one flaky pigment is present in an amount of about 5 to about 60 wt. %, in relation to the total solids content of the heat-sensitive layer.

11. A self-adhesive, heat-sensitive recording material according to claim 1 wherein said at least one flaky pigment comprises kaolin.

12. A self-adhesive, heat-sensitive recording material according to claim 1, characterised in that the at least one colour former is fluoran dye.

13. A self-adhesive, heat-sensitive recording material according to claim 1, characterised in that the siliconised layer comprises acrylic polyorganosiloxane.

14. The self-adhesive heat-sensitive recording material according to claim 13, wherein the acrylic polyorganosiloxane comprises a mixture of at least two acrylic polyorganosiloxanes.

15. A self-adhesive, heat-sensitive recording material according to claim 1, characterised in that the adhesive layer includes a hot-melt adhesive comprised of rubber and/or acrylate.

16. The self-adhesive heat-sensitive recording material according to claim 1, characterized in that the flaky pigment has a ratio of diameter to thickness of about 15 to 30:1.

17. The self-adhesive heat-sensitive recording material according to claim 1, characterized in that at least about 85% of the flaky pigment is comprised of particles having a particle size of about <41m.

18. The self-adhesive heat-sensitive recording material according to claim 1, wherein the siliconized layer consists essentially of siloxane.

19. A self-adhesive, heat-sensitive recording material, comprising a paper carrier substrate, a heat-sensitive colour-forming layer applied to one side of the paper carrier substrate, said heat-sensitive colour-forming layer comprising at least one non-phenolic colour developer, which is N-(ptoluenesulfonyl)-N'-(3-(p-toluenesulfonyloxy)phenyl)-urea and/or [N-[2-(3-phenylureido)phenyl]benzenesulfonamide, at least one colour former, which is 3-N-n-dibutylamino-6-methyl-7-anilinofluoran, at least one flaky pigment, which is talcum in an amount from about 5 to 60 wt.% in relation to the total solids content of the heat-sensitive colour-forming layer, a binder, and a sensitizer, which is 2-benzyloxynaphthalene, a siliconized layer on an upper side of the heat-sensitive colour-forming layer applied on the carrier substrate, wherein the siliconized layer is based on at least one siloxane and contains a photoinitiator, and an adhesive layer on a side of the carrier substrate facing away from the heat-sensitive colour-forming layer, characterised in that the siliconized layer rests directly on the heat-sensitive colour-forming layer.

20. A self-adhesive, heat-sensitive recording material, comprising a carrier substrate, a heat-sensitive colour-forming layer applied to one side of the carrier substrate, said layer comprising at least one non-phenolic colour developer and at least one colour former, a siliconised layer on an upper side of the heat-sensitive colour-forming layer applied on the carrier substrate, and an adhesive layer on a side of the carrier substrate facing away from the heat-sensitive colour-forming layer, characterised in that the siliconised layer rests directly on the heat-sensitive colour-forming layer, and wherein the heat-sensitive colour-forming layer comprises at least one flaky pigment and at least one sensitizer selected from the group of fatty acid amide, ethylene-bis-fatty acid amide, wax, carboxylic acid ester, aromatic ether, aromatic sulfone, aromatic sulfonamide.

21. A self-adhesive, heat-sensitive recording material, comprising a carrier substrate, a heat-sensitive colour-forming layer applied to one side of the carrier substrate, said layer comprising at least one non-phenolic colour developer and at least one colour former, a siliconised layer on an upper side of the heat-sensitive colour-forming layer applied on the carrier substrate, and an adhesive layer on a side of the carrier substrate facing away from the heat-sensitive colour-forming layer, characterised in that the siliconised layer rests directly on the heat-sensitive colour-forming layer, and wherein the heat-sensitive colour-forming layer comprises at least one flaky pigment and at least one sensitizer which have a melting point between about 90 and about 150 ° C.

* * * * *